US006254182B1

(12) United States Patent
Townsend

(10) Patent No.: US 6,254,182 B1
(45) Date of Patent: Jul. 3, 2001

(54) GOLF CART SEAT COVER

(76) Inventor: Sue A. Townsend, 5128 Point Alexis Dr., Boca Raton, FL (US) 33486

( * ) Notice: Subject to any disclaimer, the term of this patent is extended or adjusted under 35 U.S.C. 154(b) by 0 days.

(21) Appl. No.: 09/466,639

(22) Filed: Dec. 20, 1999

(51) Int. Cl.[7] ..... A47C 31/00
(52) U.S. Cl. ..... 297/228.13; 297/219.1; 297/DIG. 6
(58) Field of Search ..... 297/DIG. 6, 219.1, 297/224, 228.13

(56) References Cited

U.S. PATENT DOCUMENTS 1,704,346 * 3/1929 Schneider .
2,904,103 * 9/1959 Nail .
3,066,323 * 12/1962 Kintner .
4,693,511 * 9/1987 Seltzer et al. .
5,121,938 * 6/1992 Gross et al. .

FOREIGN PATENT DOCUMENTS

1143275 * 2/1969 (GB) .

* cited by examiner

*Primary Examiner*—Milton Nelson, Jr.

(57) ABSTRACT

A golf cart seat cover, made from a single piece of absorbent, breathable material such as terry cloth, and sized to fit a golf cart bench seat. Tabs containing a hook and loop type fastening device secure the seat cover to the golf cart's side rails. An elastic loop in the middle of the front edge of the seat cover surrounds the golf cart's forward/reverse lever to further secure the seat cover to the golf cart's seat. When in use, this golf cart seat cover will stay in place despite movement of the cart or occupant.

3 Claims, 2 Drawing Sheets

GOLF CART SEAT COVER

BACKGROUND OF INVENTION

The present invention relates to a cover for a golf cart seat. More specific, the present invention relates to a one-piece member sized to cover the bench seat cushion of a golf cart which is secured to side rails of the golf cart.

A typical golf cart has a bench seat with a cushion upholstered with a waterproof material such as vinyl. Golf carts are utilized for various purposes, the most common being to transport golfers about the golf course. Golf carts are also used by individuals with occupations that require physical coverage of a substantial amount of land, such as car salesmen, property management and maintenance personnel, and police who patrol outdoor events.

Golf carts are mostly used outdoors in warm weather due to their open design. The vinyl type golf cart seat upholstery generally has no ventilating or breathable ability. Since golf carts are usually used in warm weather, occupants often wear short pants or skirts and therefore bare legs come in contact with the seat. More often than not, when bare legs come in contact for any length of time with an un-breathable material such as the usual vinyl seat upholstery, the legs sweat and the seat becomes wet and slick causing the occupant's legs to slip and/or stick to the seat. The result is discomfort to the occupant and an unsanitary environment.

In order to alleviate the aforementioned problems, golf cart riders often use towels, T-shirts and other articles to fashion a temporary, make-shift seat cover that can be easily removed and washed at the end of their outing. Those make-shift articles absorb sweat and body oils and also protect the body from other contaminants typically accumulated on the seats during outdoor activity. The disadvantage of using such seat coverings is that they are not secured to the seat and accordingly the user must continually readjust or reposition the article to make certain that it covers the surface beneath the user. Furthermore, it is difficult to enter the seat without disturbing the arrangement and inadvertently exposing the seat's upholstery.

Some forms of devices know of the art for seat covers other than for golf carts can be found in U.S. Pat. Nos. 5,618,082, 4,676,376, 5,618,082, 4,693,511, 5,150,947 and 5,806,925. Each is a covering for both a seat bottom and back rest, and contain fitted pockets, draw strings, clamps/clips, or the like for securing the cover to the seat. While the basic application of these devices may be similar to that of the present invention, such designs are unsuitable for use on a golf cart due to the golf cart's unique seat design and the need for coverage of only the bottom bench seat.

No device is known specifically for the purpose of providing a seat cover specifically for the bottom bench seat of a golf cart. As such, it may be appreciated that there is a need for a seat cover specifically designed for a golf cart.

BRIEF SUMMARY OF THE INVENTION

The principal object of the present invention is to provide a golf cart seat cover made of an absorbent, breathable material such as terry cloth that is designed to attach to the golf cart in a manner such that the cover will stay in place.

It is also an object of the present invention to provide such a device which is of simple, inexpensive construction.

Another object of the present invention is to provide a golf cart seat cover that is specifically fitted for a golf cart bench seat that is easy to install and remove.

Another object of the present invention is to provide a golf cart seat cover that is durable, machine washable and reusable.

An additional object of the present invention may be to provide grommets or loops on the article, to provide a means of attaching same to one's golf bag.

Another object of the present invention is to provide a golf cart seat cover that is ornamental and distinctive and may be decorative or carry an advertising message, as for example, an advertisement for a particular golf club or golf tournament.

BRIEF DESCRIPTION OF THE DRAWINGS

The features of the invention will become more apparent by reference to the following detailed description when considered in connection with the accompanying drawings wherein.

DETAILED DESCRIPTION OF THE INVENTION

Figure 1:
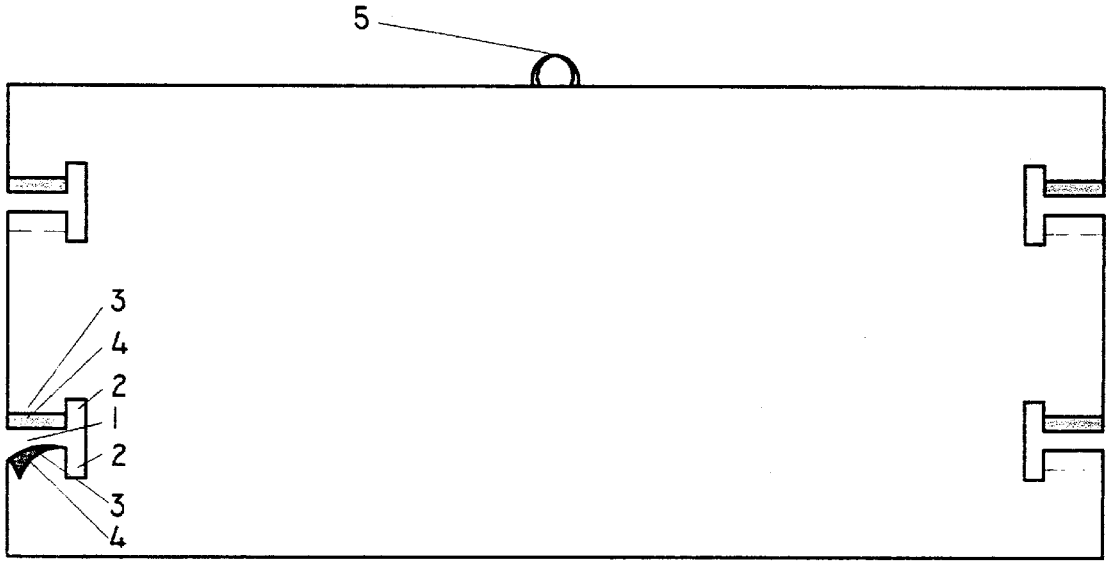
FIG. 1: An overall drawing of the present invention.

Refer to FIG. 1, which is an overall drawing of the invention. As shown in FIG. 1, the invention is a relatively simple apparatus fabricated from one piece of fabric. The invention is made from a rectangular piece of terry cloth or towel with horizontal slits 1 cut on each short side of the material, and two slits 2 cut perpendicular to the horizontal slits 1. The two pairs of tabs 3 resulting from the slits in the material contain hook and loop type a fastening device, which is used to secure the apparatus to the golf cart seat. An elastic loop 5 is attached to the middle of the long horizontal side of the seat cover, which is an additional securing device to the golf cart.

Figure 2:
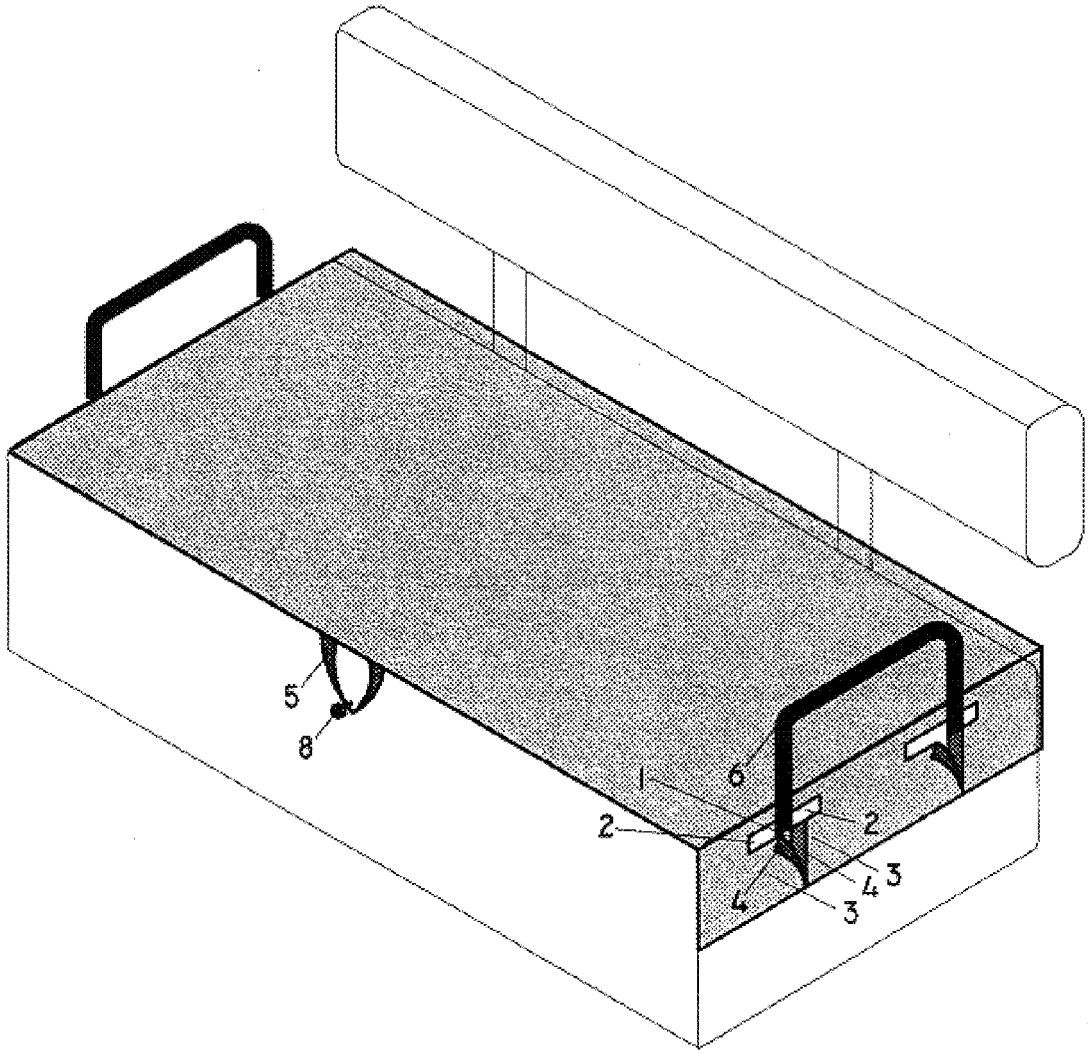
FIG. 2: A view of the present invention installed on the golf cart seat.

Refer to FIG.2 which is a drawing of the invention installed on a typical golf cart seat. The side rails 6 of the golf cart slide through the horizontal slits 1 and the tabs 3 surround the side rails 6 and fasten with Velcro or the like 4 in order to secure the apparatus in place. The slits 2 which are perpendicular to the horizontal slits 1, allow for the apparatus to slide forward or back, in order to fit different variations of golf carts. The elastic loop 5 fits around the forward/reverse lever 8 of the cart to secure the cover to front of the seat. Once fully engaged, the golf cart seat cover will remain in place, despite movement of the cart or occupant.

The foregoing description of the preferred embodiment of the invention has been presented for the purpose of illustration and description. It is not intended to be exhaustive or to limit the invention to the precise form disclosed. Many modifications and variations are possible in light of the above teaching. It is intended that the scope of the invention be limited not by this detailed description, but rather than the claims appended hereto.

What I claim is:

1. A one piece golf cart seat cover, the golf cart including a bench seat, a forward/reverse lever, and seat side rails, the seat cover comprising:

a. a single piece of material in a substantially rectangular shape, said material having a front facing longitudinal edge, a rear facing longitudinal edge, and a left and a right side edge, said front facing longitudinal edge having a midpoint;

b. slits in the material that form tabs which fasten around the golf cart seat side rails with hook and loop type fastening means to secure the seat cover to the seat side rails; and c. an elastic loop extending from the midpoint of the front facing longitudinal edge which fastens around the forward/reverse lever to secure the seat cover to the forward/reverse lever.

2. A golf cart seat cover as in claim 1, wherein said single piece of material is reusable and machine washable.

3. A golf cart seat cover as in claim 1, wherein said single piece of material is an absorbent, breathable material.

* * * * *